United States Patent [19]

Carder, Sr.

[11] 4,378,824

[45] Apr. 5, 1983

[54] FLUID DISPENSING NOZZLE

[75] Inventor: Mervin L. Carder, Sr., Fenton, Mo.

[73] Assignee: M. Carder Industries, Incorporated, Fenton, Mo.

[21] Appl. No.: 232,817

[22] Filed: Feb. 9, 1981

[51] Int. Cl.[3] ..... B65B 57/04

[52] U.S. Cl. ..... 141/206; 141/392; 74/105; 137/382.5; 251/368

[58] Field of Search ..... 141/192–229, 141/392; 74/105; 137/382, 382.5; 251/368, 244, 245, 246, 321, 322, 323

[56] References Cited

U.S. PATENT DOCUMENTS

| | | | |
|---|---|---|---|
| 2,244,100 | 6/1941 | Cole | 74/105 |
| 2,891,480 | 6/1959 | Marcum | 74/105 |
| 3,052,130 | 9/1962 | Kellogg et al. | 74/105 |

*Primary Examiner*—Houston S. Bell, Jr.

*Attorney, Agent, or Firm*—Polster, Polster & Lucchesi

[57] ABSTRACT

A fluid dispensing nozzle for dispensing gasoline includes a main valve, an actuating lever for operating the main valve, a plastic plunger to which the actuating lever for the nozzle is pivoted, and a sleeve slidably mounted on the lower end of the plunger for preventing breakage of the plunger. The sleeve includes a yoke part which surrounds both the end of the plunger and the end of the lever. A cast hand guard surrounds the yoke.

16 Claims, 3 Drawing Figures

FLUID DISPENSING NOZZLE

BACKGROUND OF THE INVENTION

This invention relates to a fluid dispensing nozzle, and in particular to the type of nozzle conventionally used in the dispensing of gasoline. A typical such nozzle is described in U.S. Pat. No. 3,540,496 to Myers and in my U.S. Pat. No. 3,757,834, the disclosure of which is hereby incorporated.

As set out in U.S. Pat. No. 3,757,834, gasoline dispensing nozzles conventionally include a casing having a main valve, a manually operable lever, and an automatic high-level shut-off means which forms a pivot for the lever. The shut-off means includes a plunger which is slidably mounted in the casing. The forward end of the lever is pivotally secured to the lower end of the plunger. When gasoline reaches the end of the dispensing nozzle, the plunger is allowed to drop to a point at which the lever is no longer able to open the main valve of the nozzle.

In the present commercial practice, the plunger is molded of plastic, such as a homopolymer acetal resin sold by E. I. DuPont de Nemours & Company, Inc. under the trade name Delrin. The lower end of the plunger includes a transverse hole. The lever is commercially formed from sheet metal to have a U-shaped cross-section with a pair of upstanding side walls and a lower web part. At the forward end of the lever the web portion is cut away, and holes are provides in the up-turned sides. A pivot pin passes through the holes in the plunger and the lever and is trapped between the up-turned sides of a hand guard which surrounds the end of the plunger and the lever.

It has been found that the lower end of the Delrin plunger frequently breaks off in use. Although this breakage does not create an immediate danger, it does render the nozzle unusable until the entire nozzle is rebuilt and therefore constitutes a serious annoyance and a considerable expense to the user.

SUMMARY OF THE INVENTION

One of the objects of this invention is to provide a nozzle, particularly a gasoline dispensing nozzle, in which breakage of the plunger is greatly reduced.

Another object is to provide such a nozzle which is not substantially more difficult or expensive to manufacture than presently known nozzles.

Other objects will occur to those skilled in the art in light of the following description and accompanying drawings.

In accordance with this invention, generally stated, a fluid dispensing nozzle is provided including a casing having a main valve, a manually operable lever, and an automatic high-level shut-off means which forms a pivot for the lever, the shut-off means including a plunger which is slidably mounted in the casing, a hole extending transversely through the plunger at a lower end thereof, a pivot pin extending through the hole in the plunger for pivotally mounting the plunger to the forward end of the lever, characterized by yoke means extending upwardly from the pivot pin for preventing the application of a substantial bending moment to the plunger adjacent the hole through the plunger.

Preferably, the lever is formed of sheet metal and includes a pair of side walls surrounding the lower end of the plunger. The pivot pin passes through the hole in the plunger and through corresponding holes in the side walls of the lever. The yoke means surrounds the side walls of the lever. Preferably, the yoke means includes holes for the pivot pin, and the pivot pin is sufficiently long that it is trapped by the side walls of the hand guard. Also preferably, the yoke means includes an upper spacer part, slidably mounted on the plunger, which limits the upward movement of the plunger. It will be seen that the preferred construction is a simple modification of the standard slidable spacer on the plunger, in which the yoke part is formed by a pair of downwardly extending arms with holes through them for the standard pivot pin.

Preferably, the plunger and the yoke means are formed of a homopolymer acetal resin.

I have observed that the breakage of plungers in gasoline dispensing nozzles appears to be caused by transverse force applied to the lever, that is by force transverse to the plane defined by the hand guard and the usual plane of movement of the lever. This force applies a bending moment to the lower end of the plunger adjacent the hole through it and causes it to break. In the preferred embodiment of my invention, the yoke transfers the bending moment to a part of the plunger above the hole, where the plunger is sufficiently strong that the lever will bend before the plunger breaks. The yoke is preferably sized to extend slightly below the end of the plunger, so that the yoke rests on the lower surface of the hand guard when the plunger is in its lowered position and provides additional resistance to transverse motion. The side walls of the hand guard also prevent excessive movement of the yoke, although sufficient space is allowed to prevent binding in the normal operation of the lever.

Other aspects of the invention will be better understood in light of the following description of the preferred embodiment.

DESCRIPTION OF THE PREFERRED EMBODIMENT

Figures 1, 2, 3:
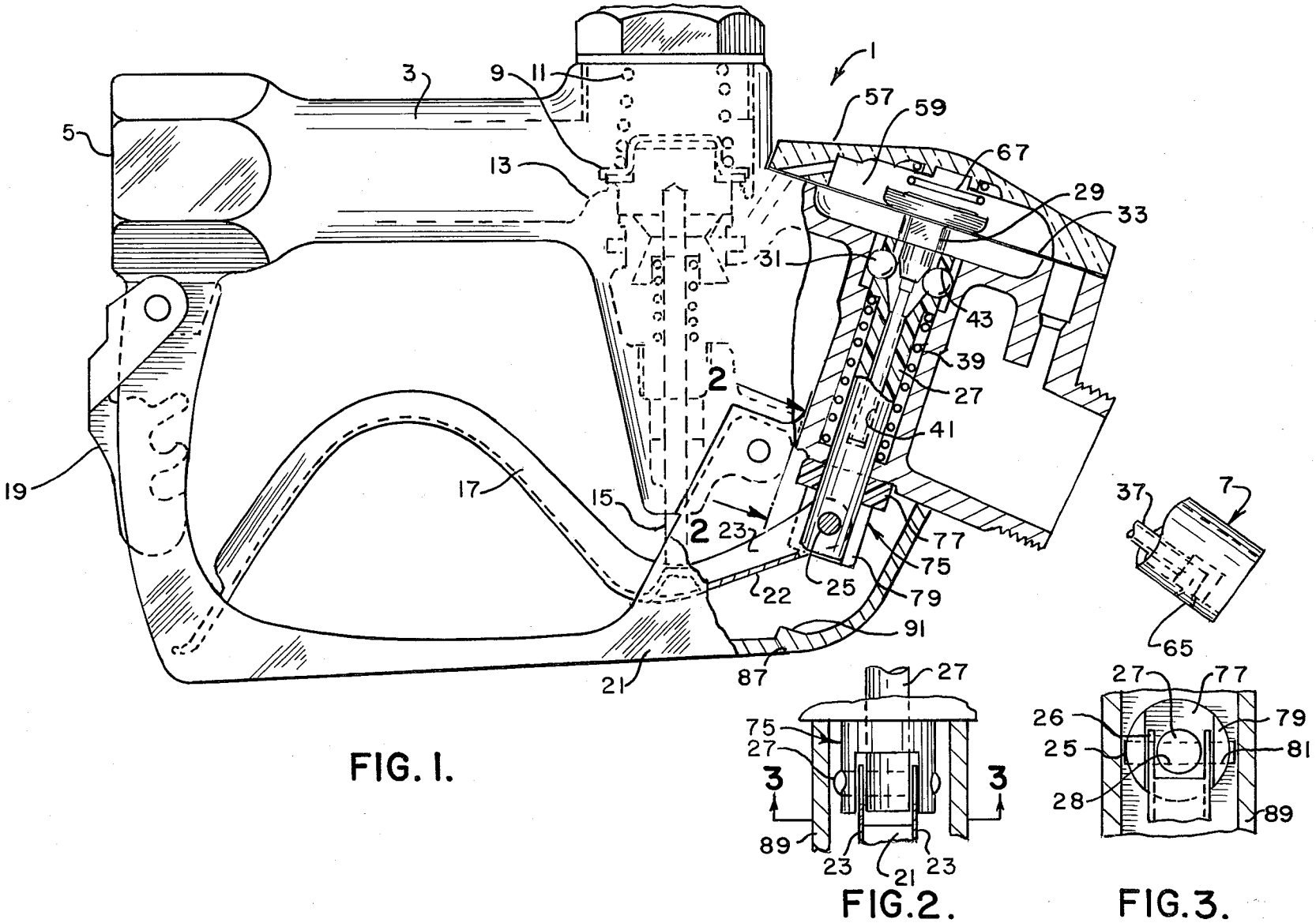
FIG. 1 is a view in side elevation, partially cut away, of a fluid dispensing nozzle embodying my invention.
FIG. 2 is a detail taken along the line 2—2 of FIG. 1.
FIG. 3 is a detail taken along the line 3—3 of FIG. 2.

Referring now to the drawings, reference numeral 1 indicates a gasoline dispensing nozzle incorporating my invention. The nozzle 1 includes a casing 3 having a passage through it including an inlet 5 and an outlet 7. Inlet 5 is threaded to receive a flexible hose or the like from a gasoline pump, and the outlet 7 includes a spout adapted to be inserted into the fill tube of a vehicle gasoline tank. A main poppet valve 9 is urged by a spring 11 against a cooperating valve seat 13 to close the passage through the casing 3. A stem 15 extending from the lower end of the valve 9 is slidably mounted in the casing 3. The lower end of the stem 15 is engaged by a manually operable lever 17 which is normally suitably pivoted to lift the main valve 9 from its seat 13 when the lever 17 is lifted. Suitable hold-open means, such as clip 19 are preferably provided on a cast hand-guard 21.

The lever 17 is formed of sixteen gauge sheet steel, and is U-shaped in cross section, having a lower wall 22 and side walls 23. The central part of the lever 17 is upwardly bowed to form a hand hold. At the forward end of the lever 17, the lower wall 22 is cut away. Holes 26 are provided in the side walls 23 at the forward end of the lever. The forward end of the lever 17 is held by a pivot pin 25 to the lower end of a cylindrical plunger 27 which is mounted for reciprocation in the casing 3. The pivot pin extends through a transverse hole 28 in the lower end of the cylindrical plunger 27 and through the holes 24 in the end portions of the side walls 23 of the lever 17 and extends somewhat beyond the side walls 23.

The plunger 27 forms a part of an automatic shut-off system for shutting off the flow of gasoline through the nozzle when the lever of gasoline in the tank being filled reaches the end of the spout. The shut-off system includes the plunger 27, a latch pin 29, three latching balls 31, a diaphragm 33, a venturi means, and a breather tube indicated at 37. The plunger 27 is conventionally made of plastic, the commercially preferred plastic being a homopolymer acetal resin sold by E. I. DuPont de Nemours & Company, Inc. under the trade name Delrin, which has a low coefficient of friction, dimensional stability and resistance to attack by gasoline. A coil spring 39 biases the plunger 27 upward. The latch pin 29 extends into a blind axial bore 41 in the upper end of the plunger 27. Three radial openings 43 extending from the outer surface of the cylindrical plunger 27 into the axial bore 41 act as guideways for the latching balls 31. The latch pin 29 is preferably of the form shown in my prior U.S. Pat. No. 3,757,834. The upper end of the latch pin 29 is secured to the center of the diaphragm 33. The periphery of the diaphragm 33 is secured to the casing 3 by a cap 57 and defines with the cap 57 a pressure chamber 59 in the casing. The pressure chamber 59 communicates with a hole 65 in the side of the spout through a passageway including the breather tube 37. A balance spring 67 on the upper side of the diaphragm 33 positions the latch pin and determines the sensitivity of the automatic shut-off system.

As thus far described, the nozzle 1 is entirely conventional, and is in widespread commercial use. Its operation is well known, and is described in the previously-mentioned patents. Briefly, when the handle 17 is lifted, the latch pin 29 and balls 31 hold the plunger 27 in its upward position, and the handle lifts the valve 9 from the seat 13 to permit gasoline to flow through the nozzle casing 3. When the opening 65 in the nozzle becomes submerged, the decrease in pressure in chamber 59 causes the latch pin to be pulled upward, and the plunger 27 is released. Because the valve spring 11 is far stronger than the spring 39, the valve stem 15 forces the plunger 27 and the lever 17 down and the valve 9 closes.

Commercially available nozzles also include an annular collar slidably mounted on the plunger between the exterior of the casing and the end of the lever 17. The collar limits the upward movement of the plunger 27 when the lever 17 is released. In accordance with the present invention, an improved collar 75 is provided on the plunger 27. The collar is preferably made of an acetal homopolymer resin such as "Delrin". The collar 75 includes an upper annular part 77 and a pair of downwardly extending legs 79 which form a yoke surrounding the lower end of the plunger 27 and the forward ends of the lever side walls 23. Holes 81 are provided in the legs 79. The pivot pin 25 fits snugly into the holes 81. The legs 79 extend slightly below the end of the plunger 27.

The hand guard conventionally is cast with a U-shaped cross section and includes a lower wall 87 and side walls 89. The lower wall 87 is cut away at the rear of the hand guard 21 to accommodate the clip 19. Below the plunger 27, a ledge 91 is conventionally provided in the hand guard 21. When the plunger is in its lowered position, the legs 79 of the collar 75 rest on the ledge 91. In both the raised and lowered position of the plunger 27, the legs 79 are spaced about one-sixteenth inch from the side walls 89.

It has been found that this modification of the standard collar on the plunger 27 has remarkable and unexpected effectiveness in preventing the breakage of the plunger. In tests of the improved nozzle, transverse force on the lever 17 (i.e., a force to the left or right as viewed in FIG. 2 or 3) which regularly breaks the plunger of a conventional nozzle merely bends the lever 17.

Numerous variations in the fluid dispensing nozzle of the present invention, within the scope of the appended claims, will occur to those skilled in the art in light of the foregoing disclosure.

I claim:

1. A fluid dispensing nozzle including a casing defining a flow passage having an inlet and an outlet; a main valve in said casing for selectively opening and closing said flow passage, said main valve including a valve stem slidably mounted in said casing; a manually operable lever engaging said valve stem for operating said main valve; an automatic high-level shut-off means for disabling said lever and shutting said main valve in response to filling of a tank or the like with said fluid, said shut-off means including a plunger slidably mounted in said casing; a hole extending transversely through said plunger at a lower end thereof; a pivot pin extending through said hole in said plunger and pivotally mounting said plunger to the forward end of said lever; by and yoke means extending upwardly from said pivot pin on opposite sides of said plunger for preventing application to said plunger, adjacent said hole through said plunger, of a substantial bending moment sufficient to break said plunger by transverse motion of said lever.

2. The nozzle of claim 1 wherein the nozzle includes a hand guard, side walls of said hand guard extending around each end of the lever on both transverse sides of the lever.

3. The nozzle of claim 1 wherein the yoke means comprises means for transfering a bending moment caused by transverse motion of the lever to a part of the plunger above the hole in the plunger.

4. The nozzle of claim 1 wherein said lever and said yoke means are so constructed and arranged that exertion of a transverse force on the lever will cause the lever to bend before the plunger breaks.

5. The nozzle of claim 2 wherein the yoke means extends slightly below the end of the plunger, the yoke means resting on a lower surface of the hand guard when the plunger is in its lowered position.

6. The nozzle of claim 5 wherein the side walls of the hand guard also prevent excessive movement of the yoke means.

7. The nozzle of claim 6 wherein the lever is formed of sheet metal and includes a pair of side walls surrounding the lower end of the plunger, the yoke means surrounds the side walls of the lever, and the pivot pin passes through the hole in the plunger, through corresponding holes in the side walls of the lever, and through corresponding holes in the yoke means.

8. The nozzle of claim 1 wherein the yoke means includes upper spacer means, mounted on the plunger, for limiting upward movement of the plunger.

9. The nozzle of claim 1 wherein the plunger and the yoke means are formed of an acetal resin.

10. A fluid dispensing nozzle including a casing defining a flow passage having an inlet and an outlet; a main valve in said casing for selectively opening and closing said flow passage, said main valve including a valve stem slidably mounted in said casing; an automatic high-level shut-off means for shutting said main valve in response to filling of a tank or the like with said fluid, said shut-off means including a plunger slidably mounted in said casing, a hole extending transversely through said plunger at a lower end thereof; a manually operable lever engaging said valve stem for operating said main valve, said lever including a pair of side walls straddling said lower end of said plunger; openings extending through said pair of side walls of said lever in register with said hole in said plunger; a pivot pin extending through said hole in said plunger and said openings in said lever, said pivot pin pivotally mounting said plunger to a forward end of said lever; and a hand guard, side walls of said hand guard extending around each end of said lever on both transverse sides of said lever, characterized by a yoke, said yoke including a pair of legs extending between said side walls of said lever and said side walls of said hand guard, said yoke being constructed and arranged to prevent application to said plunger, adjacent said hole through said plunger, of a substantial bending moment sufficient to break said plunger by transverse motion of said lever.

11. The nozzle of claim 10 wherein said yoke includes upper spacer means, mounted on said plunger above said hole in said plunger, for limiting upward movement of said plunger, said legs being formed integrally with said upper spacer means, said legs transfering a bending moment caused by transverse motion of said lever to said upper spacer means, hence to a part of said plunger above said hole in said plunger.

12. The nozzle of claim 11 further including holes extending through said legs of said yoke in register with said hole in said plunger, said pivot pin extending through said holes in said legs.

13. The nozzle of claim 10 wherein said side walls of said hand guard prevent excessive movement of said yoke and said plunger.

14. The nozzle of claim 10 wherein said lever is formed of sheet metal, and wherein exertion of a transverse force on said the lever will cause said lever to bend before said plunger breaks.

15. The nozzle of claim 10 wherein said legs of said yoke extend slightly below said end of said plunger, said yoke resting on a lower surface of said hand guard when said plunger is in its lowered position.

16. The nozzle of claim 10 wherein said plunger is formed of an acetal resin.

* * * * *